US007475832B2

(12) United States Patent
Amron

(10) Patent No.: US 7,475,832 B2
(45) Date of Patent: Jan. 13, 2009

(54) PORTABLE WATER DISCHARGING AMUSEMENT DEVICE AND RELATED METHODS

(75) Inventor: Alan Amron, Brooklyn, NY (US)

(73) Assignee: Tropical Ventures LLC, Hempstead, NY (US)

( * ) Notice: Subject to any disclaimer, the term of this patent is extended or adjusted under 35 U.S.C. 154(b) by 90 days.

(21) Appl. No.: 11/143,353

(22) Filed: Jun. 2, 2005

(65) Prior Publication Data

US 2006/0273188 A1 Dec. 7, 2006

(51) Int. Cl.
*B05B 17/08* (2006.01)

(52) U.S. Cl. ..... 239/23; 239/251; 239/225.1; 239/263; 239/211

(58) Field of Classification Search ..... 239/23, 239/211, 251, 263, 255.1, 128, 263.1, 240, 239/222.17

See application file for complete search history.

(56) References Cited

U.S. PATENT DOCUMENTS

| | | | | | |
|---|---|---|---|---|---|
| 1,150,940 | A | | 8/1915 | Irish | |
| 1,798,488 | A | * | 3/1931 | Orr | 239/227 |
| 1,941,786 | A | | 1/1934 | Carley et al. | |
| 2,381,740 | A | * | 8/1945 | Grelson | 239/231 |
| 2,830,739 | A | | 4/1958 | Moye | |
| 2,998,166 | A | | 8/1961 | Klawiter | |
| 3,399,638 | A | | 9/1968 | Bishop et al. | |
| 3,493,179 | A | | 2/1970 | Lee | |
| 3,804,336 | A | | 4/1974 | Koeppe | |
| 4,335,677 | A | * | 6/1982 | Nagata et al. | 118/306 |
| 4,397,879 | A | | 8/1983 | Wilson | |
| 4,542,853 | A | | 9/1985 | Diamond | |
| 4,615,488 | A | | 10/1986 | Sands | |
| 4,709,691 | A | | 12/1987 | Lemons et al. | |
| 4,821,961 | A | | 4/1989 | Shook | |
| 4,842,200 | A | | 6/1989 | Hermansson | |
| 4,989,786 | A | | 2/1991 | Kranzle et al. | |
| 5,024,382 | A | | 6/1991 | Shook et al. | |
| 5,060,863 | A | * | 10/1991 | Hammelmann | 239/252 |
| 5,086,974 | A | | 2/1992 | Henshaw | |
| 5,104,043 | A | | 4/1992 | Pacht | |
| 5,224,652 | A | * | 7/1993 | Kessler | 239/211 |
| 5,244,153 | A | | 9/1993 | Kuhn et al. | |
| 5,297,979 | A | * | 3/1994 | Amron | 446/16 |
| 5,392,968 | A | | 2/1995 | Dark | |
| 5,395,053 | A | * | 3/1995 | Frech | 239/227 |
| 5,427,320 | A | | 6/1995 | Mak et al. | |
| 5,433,646 | A | * | 7/1995 | Tarng | 446/473 |
| 5,456,413 | A | | 10/1995 | Ellis | |
| 5,505,380 | A | * | 4/1996 | Jun | 239/211 |
| 5,577,945 | A | | 11/1996 | LaBelle | |
| 5,582,532 | A | | 12/1996 | Tucker | |
| 5,586,688 | A | * | 12/1996 | Johnson et al. | 222/61 |
| 5,667,138 | A | | 9/1997 | Crampton | |

(Continued)

*Primary Examiner*—Len Tran
*Assistant Examiner*—Trevor McGraw
(74) *Attorney, Agent, or Firm*—Cohen Pontani Lieberman & Pavane LLP

(57) ABSTRACT

A portable water sprinkling amusement device incorporates a water storage reservoir for transporting its own supply of water, at least one nozzle assembly defining at least one discharge orifice, an avenue of release establishing fluid communication between the water storage reservoir and the at least one nozzle assembly, and a fluid transfer system operative to develop forces for causing a stream of liquid to flow through the avenue of release and out of the discharge orifice upon actuation of an on/off mechanism.

20 Claims, 5 Drawing Sheets

U.S. PATENT DOCUMENTS 5,725,680 A * 3/1998 Mathieus ..... 134/38
5,826,750 A * 10/1998 Johnson ..... 222/79
5,878,914 A * 3/1999 Johnson ..... 222/79
6,007,003 A 12/1999 Wang
6,129,293 A 10/2000 Jaeger
6,151,824 A * 11/2000 Clayton ..... 42/54
6,155,494 A * 12/2000 Fabbri et al. ..... 239/240
6,186,367 B1 2/2001 Harrold
6,196,475 B1 3/2001 Jaeger
6,199,771 B1 3/2001 Clearman et al.
6,250,506 B1 6/2001 Geiger et al.
6,331,130 B1 * 12/2001 Thai ..... 446/15
6,364,162 B1 * 4/2002 Johnson et al. ..... 222/61
6,422,480 B1 * 7/2002 Richmond ..... 239/10
6,540,108 B1 * 4/2003 Johnson ..... 222/79
6,594,843 B1 7/2003 Wilkins
6,766,967 B2 7/2004 Harris et al.
6,892,902 B2 * 5/2005 Hornsby et al. ..... 222/79
6,899,286 B2 * 5/2005 Blessing ..... 239/225.1
6,935,531 B1 8/2005 Clayton
6,959,838 B2 11/2005 Eddins et al.
7,032,837 B2 * 4/2006 Eddins et al. ..... 239/255
7,111,795 B2 * 9/2006 Thong ..... 239/383
7,182,477 B1 * 2/2007 Hartz ..... 362/96
2001/0019083 A1 9/2001 Marks
2002/0030066 A1 * 3/2002 McKenna ..... 222/325
2003/0071141 A1 4/2003 Rieben
2003/0085303 A1 5/2003 Jaeger
2004/0164090 A1 8/2004 Eddins et al.
2005/0035148 A1 * 2/2005 Zimmerman ..... 222/79
2005/0173559 A1 8/2005 Eddins et al.

* cited by examiner

PORTABLE WATER DISCHARGING AMUSEMENT DEVICE AND RELATED METHODS

FIELD OF THE INVENTION

The present invention relates generally to water discharging amusement devices and, more particularly, to sprinkler systems adapted to dispense a spray pattern of water into which children can jump during play.

DISCUSSION OF THE BACKGROUND ART

Water play toys have long been a source of great amusement and recreation value. In summer months in particular, toys which combine action and the use of water have provided diversion and a source of cooling at the same time. It has frequently been a favorite pastime of children to play using lawn sprinklers and the like by turning the sprinklers on and running through them. Even simply turning on a garden hose and squirting play companions has been popular attesting to the fascination that children have for water and water play.

In U.S. Pat. No. 5,297,979 issued to the inventor herein, Alan Amron, on Mar. 29, 1994, there is disclosed a water sprinkler having a housing that is formed into the shape of a dolphin and that includes a plurality of rotating sprinkler heads for providing a spray of water when the device is connected to a typical garden hose. A water-turbine powered mechanism within the housing generates bubbles which are released through an opening at the top of the housing so that children can jump and play within a spray of water having bubbles interspersed therein.

A reaction type of water sprinkling toy is shown in U.S. Pat. No. 3,700,172. Water communicated by a hose to a housing is conducted through a plurality of internal tubes to spray nozzles opening downwardly from the housing. The force of water emitted by the nozzles causes the housing to lift and hover over the surface on which it is placed at rest. As the term implies, the toy of the U.S. Pat. No. 3,700,172 is one which is caused to rise in reaction to the forces encountered as water passes through the outlet nozzles. Other water reaction toys are also known, including that shown in U.S. Pat. No. 3,079,727 and known as the Water Wiggle. The action/reaction principle is also graphically illustrated by a hose having a constricted outlet which writhes like a snake when a source of water pressure is connected to the hose.

Other toys that generate a spray of water for play purposes are disclosed by Janszen, U.S. Pat. No. 4,573,679 and by Stanley, U.S. Pat. No. 4,205,785.

All prior art water sprinkling amusement devices have one characteristic in common—they are intended for attachment to a supply of municipally pressurized water and, more specifically, by for attachment to the end of a garden hose. A continuing need therefore exists for water sprinkling amusement devices which are portable so that they can be used anywhere—even where a source of municipally pressurized water is not available.

SUMMARY OF THE INVENTION

The aforementioned deficiency is addressed, and an advance is made in the art, by a portable water spraying toy device that incorporates a water storage reservoir for transporting its own supply of water, a housing, at least one nozzle assembly defining at least one discharge orifice, an avenue of release establishing fluid communication between the water storage reservoir and the at least one nozzle assembly, and a fluid transfer system operative to develop forces for causing a stream of liquid to flow through the avenue of release and out of the corresponding discharge orifice(s) upon actuation of an on/off mechanism.

In accordance with an illustrative embodiment of the present invention, the at least one nozzle assembly is rotatably secured to the housing and is dimensioned and arranged to rotate relative thereto so that while the on/off mechanism is in the "on" position, the water being discharged through the discharge orifice traverses an arcuate path while the housing remains stationary. The stream discharged has a helical configuration, which is unbroken for so long as water is flowing through the avenue of release (that is, for example, until the on/off mechanism returns to an off position or until the supply water in the reservoir is exhausted).

Amusement devices constructed in accordance with the aforementioned illustrative embodiment may include two or more nozzle assemblies, each being adapted to rotate about a correspondingly different axis of rotation. By way of example, a first nozzle assembly can be rotatably coupled to the housing for rotation about a vertical axis to thereby create a vertically extending spiral flow, while second and third nozzle assemblies can be rotatably coupled to the housing for rotation about respective axes which are inclined relative to a horizontal plane transacting the housing. It will, of course, be readily appreciated by those skilled in the art that the greater the number of nozzle assemblies (and associated discharge openings), the faster the supply of water contained in the reservoir will be depleted. To that end, it may be desirable to provide a larger reservoir or to employ a modular reservoir design which permits an empty reservoir to be detached from the avenue of release and a full, replacement (or "spare") reservoir to be secured thereto in its place.

Automatic rotation of the nozzle assembly to produce a helical discharge effect in accordance with the illustrative embodiment of the present invention can be achieved in a variety of ways. An illustrative nozzle assembly constructed in accordance with this embodiment of the invention includes a electrically motorized drive assembly responsive to actuation of an on/off selector switch (forming part of a circuit that also includes a battery) to drive a transmission system engageable with the at least one nozzle assembly.

Instead of a motor, the force for spinning the at least one nozzle assembly may be provided via the pressurized water stream traversing the avenue of release, and the on/off mechanism can take the form of a resiliently biased valve selectively manipulable between a normally closed, off position, and a latched open, on position. For example, a water turbine assembly can be placed at an appropriate location in the flow path. By way of yet another example, the discharge outlet of the nozzle assembly may be dimensioned and arranged to impart a nozzle reaction force—that is offset relative to the axis of nozzle assembly rotation—as the stream of water is discharged. Even a relatively small angle of inclination of the discharge stream relative to a plane orthogonal to the rotational axis of the nozzle assembly is sufficient to induce rotation of the at least one nozzle assembly. Indeed, the latter configuration has constituted the underlying principle of operation for lawn sprinklers for the past eighty years or more.

It should be noted that water sprinkling amusement devices constructed in accordance with the present invention need not utilize a nozzle assembly of the rotating type, and that instead of providing a continuous flow while the on/off mechanism is in the "on" position, the inventor herein contemplates intermittent modes of operation in which the flow is "pulsed" with intervals during which water is discharged via the discharge orifice(s) of the at least one nozzle assembly being separated by intervals during which no water is being discharged. Such an intermittent operation has the advantage of reducing the rate of water depletion and may add excitement during play as children seek to "time" their exit and entry into the discharge path(s) of the device.

It should also be noted that although a principal object of the present invention is to provide a water sprinkling amusement system which can be employed regardless of whether a source of municipally pressurized water is nearby, it is contemplated that there will be times when such a source is available. Accordingly, embodiments of the invention may incorporate an adapter for permitting water under pressure to flow directly into the reservoir such that the pressurization of the water is maintained without the need of operating the fluid transfer system. In that regard, the fluid transfer system in a pressurized embodiment may comprise, for example, a manually operable fluid transfer pump or a motorized pump adapted to force water or air into the reservoir when the municipal source of pressurization is not available. In non-pressurized embodiments, a motorized pump can be provided to draw water from the reservoir and force the same into the avenue of release.

BRIEF DESCRIPTION OF THE DRAWINGS

The various features and advantages of the present invention would be better understood by reference to the detailed description which follows, taken in conjunction with the accompanying drawings, in which.

DETAILED DESCRIPTION OF THE INVENTION

Figure 1:
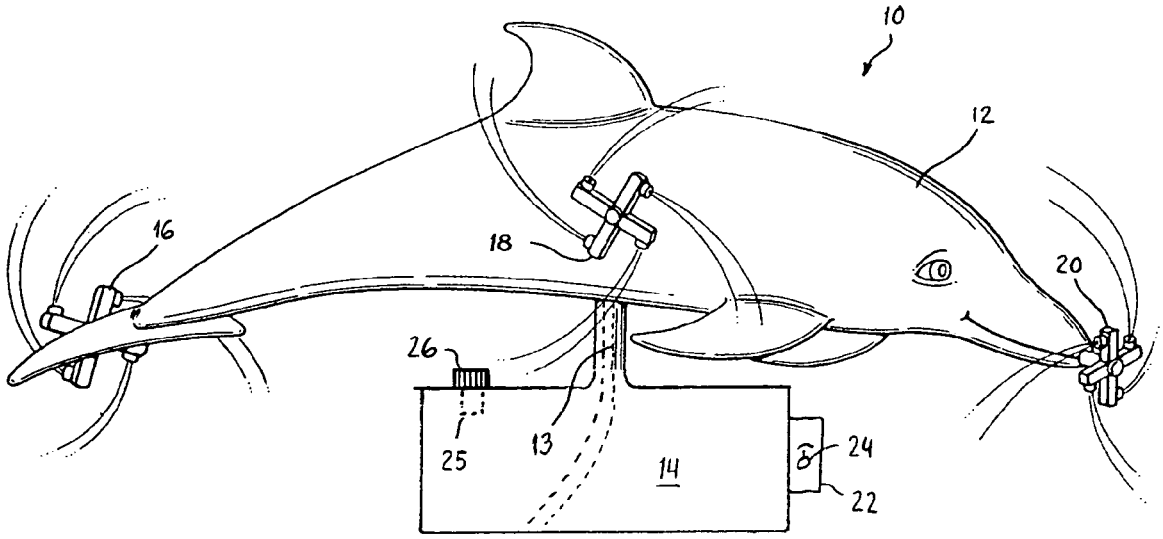
FIG. 1 is a side elevation view depicting a portable water discharging amusement device constructed in accordance with a first illustrative embodiment of the present invention, the device being equipped with nozzle assemblies adapted to rotate automatically, as water is discharged, and with a motorized pump for pressurizing a water storing reservoir.

The accompanying Figures and this description depict and describe embodiments of a water sprinkler amusement device in accordance with the present invention, and features and components thereof. The present invention also encompasses a method of making and using embodiments of the amusement device. As used herein, the phrases or terms "water discharging amusement device," "toy sprinkler," "water sprinkler amusement device" and the like are intended to encompass a portable structure or structures configured to automatically project, throw, squirt, launch or shoot water upwardly into the air so that it falls down upon a child during play, and which can be operated even when not attached to the end of a garden hose. It is important to note, however, that water sprinkler devices constructed in accordance with the present invention can, if an optional mode of operation is desired, be configured for attachment to a garden hose when a source of municipally pressurized water is close by. It should also be noted that any references herein to front and back, right and left, top and bottom and upper and lower are intended for convenience of description, not to limit the present invention or its components to any one positional or spacial orientation.

With regard to fastening, mounting, attaching or connecting components of the present invention to form the water discharging amusement device as a whole, unless specifically described otherwise, such are intended to encompass conventional fasteners such as screws, nut and bolt connectors, threaded connectors, snap rings, detent arrangements, clamps such as screw clamps and the like, rivets, toggles, pins and the like. Components may also be connected by adhesives, glues, welding, ultrasonic welding, and friction fitting or deformation, if appropriate, and appropriate liquid and/or airtight seals or sealing devices may be used. Electronic portions of the device may use conventional, commercially available electronic components, connectors and devices such as suitable wiring, connectors, printed circuit boards, microchips, speakers, lights, LED's, liquid crystal displays, pressure sensors, liquid level sensors, audio components, inputs, outputs and the like. Unless specifically otherwise disclosed or taught, materials for making components of the present invention may be selected from appropriate materials such as metal, metallic alloys, natural and man-made fibers, vinyls, plastics and the like, and appropriate manufacturing or production methods including casting, pressing, extruding, molding and machining may be used.

With regard to the manner in which water is urged to flow toward a discharge opening upon actuation of an on/off mechanism, it should be borne in mind that although at least one of the embodiments described herein incorporates an on-board pump for pressurizing a water-containing, fixed-volume chamber with air, the invention is not limited to such configurations. For example, if a periodic sequence of brief discharges are desired, a motorized pump arrangement utilizing a reciprocating piston may be employed. By way of further example, the water storing reservoir may be configured as an expandable bladder dimensioned and arranged to receive and store water from a hose end adapter coupled to a municipally pressurized water source (as taught by U.S. Pat. Nos. 4,854,480 and 4,735,239 to Shindo and Salmon et al, respectively). By way of still further example, a water discharging amusement device constructed in accordance with the teachings of the present invention may utilize both a bladder for storing pressurized water and an on-board, manually operated, fluid transfer pump for transferring fluid from an unpressurized water chamber having a fill cap to the bladder. An example of the latter arrangement is disclosed in U.S. Pat. No. 5,875,927 entitled TOY GUN HAVING AN EXPANDABLE TEAR DROP SHAPED BLADDER FOR EJECTION OF LIQUID THEREFROM. It suffices to say that the manner in which water ejection forces are developed is of no particular consequence to the inventor herein except insofar as manufacturing cost, simplicity and ease of use are always considerations to be borne in mind.

Figure 2:
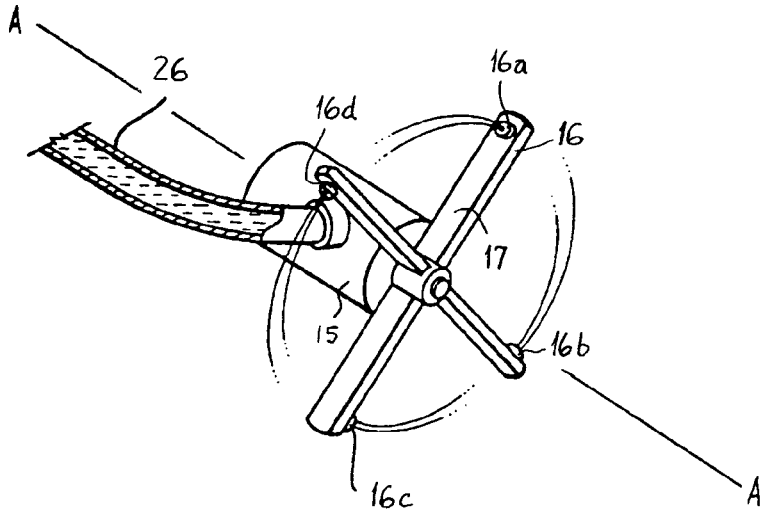
FIG. 2 is a perspective view depicting an exemplary rotating nozzle assembly utilized in the embodiment of FIG. 1.

Turning now to the drawings, in which like elements are denoted by like reference numerals throughout the several views, a first illustrative embodiment of a water discharging amusement device 10 in accordance with the present invention is depicted in FIGS. 1 and 2. The embodiment of FIGS. 1 and 2 include a generally dolphin-shaped housing or body 12 supported by a tank or reservoir 14 having a substantially planar bottom surface suitable for placement on a lawn, picnic area, beach, or the like. Extending from reservoir 14 into housing 12 is a conduit 13 which constitutes an avenue of release dimensioned and arranged to establish fluid communication between the interior of reservoir 14 and one or more nozzle assemblies, with three rotating, water discharging nozzle assemblies—indicated generally at reference numerals 16, 18 and 20—being shown in FIG. 1.

With particular reference to FIG. 2, there is shown an exemplary nozzle assemble 16 which, by way of inlet tube 26, is coupled to avenue of release 13 for fluid communication with the interior of reservoir 14 (FIG. 1). As seen in FIG. 2, each nozzle assembly as nozzle assembly 16 consists of a fluid receiving chamber and a rotating manifold or sprinkler head 17 adapted to rotate about an axis of rotation indicated generally by reference line A-A. Rotating sprinkler head 17 defines a plurality of discharge outlets or orifices, indicated generally at 16*a*, 16*b*, 16*c* and 16*d*, respectively. In the illustrative embodiment of FIGS. 1 and 2, discharge outlets 16*a*-16*d* are dimensioned and arranged.to impart a nozzle reaction force—that is offset relative to the axis of nozzle assembly rotation—as the stream of water is discharged. Sprinkler heads which operate on the principle of nozzle reaction forces are well known in the art and it is considered well within the level of skill of the ordinary artisan to device a sprinkler head having orifices of a sufficient size (flow rate) and orientation to achieve a desired configuration.

Returning to FIG. 1, it will be seen that the water receiving and/or containing pressurization tank or reservoir 14 of amusement device 10 defines a threaded fill opening 25 covered by a removable, threaded fill cap 26. A fluid transfer system generally indicated at 22 is adapted to develop forces for causing a stream of liquid to flow through conduit 23 and out of the discharge orifice upon actuation of trigger mechanism 18. In the illustrative embodiment depicted in FIG. 1, fluid transfer system 22 comprises a conventional motorized pump adapted to pressurize the contents of reservoir 14 with air.

An exemplary type of pump which may be used in the realization of fluid transfer system 22 is shown and described in a published PCT patent application by the inventor herein, PCT Serial No. WO9427107, entitled VOICE RESPONSIVE WATER EJECTING TOY and published on Nov. 24, 1994, the disclosure of which being expressly incorporated herein in its entirety. Alternatively, fluid transfer system 22 can be configured as a motorized pump operative to supply intermittent pulses of water to discharge opening 23. An example of the latter type of operation is disclosed in U.S. Pat. No. 4,022,350 entitled WATER GUN and issued to the inventor hereon on May 20, 1977. In the latter patent, a toy water gun is disclosed which incorporates a battery driven motor and associated pump. By means of reciprocating movement of the pump's piston, water is drawn from a reservoir and is discharged as a linear stream through a nozzle. The discharge is interrupted by the intake strokes of the piston so that the discharge is accomplished intermittently or in spurts rather than in a continuous stream.

In any event, in the motorized embodiment depicted in FIGS. 1 and 2, an on/off mechanism 24 in the form of a rotary on/off switch is used to close or open an electrical circuit (not shown) interconnecting the motor to a battery (not shown) or other source of electrical energy.

Figure 3:
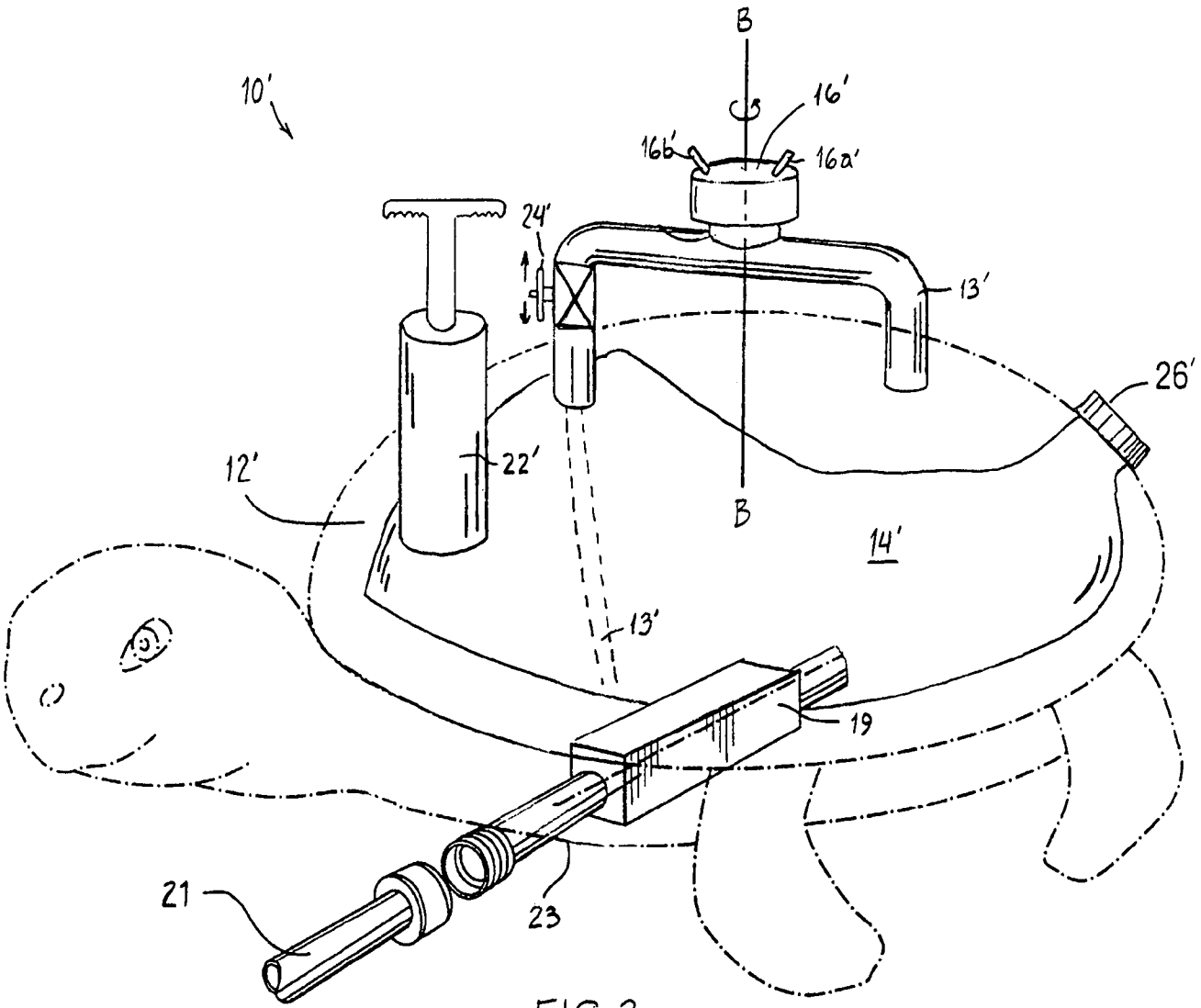
FIG. 3 is a side elevation view depicting a portable water discharging amusement device constructed in accordance with a second illustrative embodiment of the present invention, the device being equipped with a nozzle assembly adapted to rotate automatically to produce an upwardly directed spiral flow, and with a manually operable pump for pressurizing a water storing reservoir.

Turning now to FIGS. 3-6, there is shown a water discharging amusement device 10' constructed in accordance with a second illustrative embodiment of the invention. Within initial reference to FIG. 3, it will be seen that device 10' comprises a body or housing in the general shape of a turtle or other animal or character familiar to children. Unlike the embodiment of FIGS. 1 and 2, the reservoir 14' of the embodiment of FIGS. 3-6 is disposed within housing 12'. Water can be introduced via a removable, threaded fill cap 26' when a source of municipally pressurized water is unavailable. By operation of the fluid transfer system 22', water is urged from reservoir 14 through avenue of release 13 to one or more nozzle assemblies as nozzle assembly 16'. Although only one nozzle assembly is depicted in FIG. 3, it will be readily appreciated by those skilled in the art that additional nozzle assemblies may be readily incorporated into the device, as exemplified by the embodiment of FIGS. 1 and 2.

In the illustrative embodiment depicted in FIG. 3, fluid transfer system 22' consists of a conventional, manually operated pump adapted to pressurize the contents of reservoir 14' with air. Since the need to repeatedly operate the pumping mechanism—often twenty five times or more—to achieve adequate air pressurization within the reservoir, can present a challenge to the impatient user and to smaller children, a one way valve assembly indicated generally at 19 is provided to allow water under pressure from a municipal water supply or other source to be introduced directly into reservoir 14'. Such an arrangement, in the context of a toy water gun, is the subject of U.S. Pat. No. 6,234,347 entitled PRESSURIZED WATER GUN WITH SELECTIVE PRESSURIZATION and issued to the inventor herein on May 22, 2001, and gives the user an option of selecting one of two different modes of pressurization—manual pressurization using an onboard pump or, when a source of municipally pressurized water is accessible, a one-way valve system designed to admit the already-pressurized water into the reservoir. In the illustrative embodiment of FIG. 3, the end of a garden hose 21 is detachably coupled to a matingly threaded adapter 23 to allow pressurized water to flow into reservoir 14'. If such a source is available during play, the device may simply remain attached to the hose during use.

Alternatively, removable fill cap 26' may be configured with a one-way valve and be dimensioned and arranged to receive a hose end, quick-fill fitting adapter (not shown) so that water under pressure may be directed into reservoir 14' according to the teachings of the aforementioned U.S. Pat. No. 6,234,347. When a source of municipally pressurized water is not available, fill cap 26 is removed and water is poured directly into the chamber. Extending from within chamber 14' is a conventional purge valve assembly (not shown). The function of the purge valve assembly is to relieve excess pressure by venting pressurized air and/or water when the pressure exceeds a selected point.

As in the case of the embodiment of FIG. 1, the embodiment of FIGS. 3 employs one or more rotating nozzles, as exemplified by nozzle 16'. An on/off mechanism 24', in the form of a multiple position fluid control valve, is manipulable into an "off" position, in which no water may pass through avenue of release 13' to nozzle 16', an intermediate position, in which only a partial, water conserving flow, is permitted, and a fully open "on" position which allows a maximum flow rate of water to be supplied to nozzle assembly 16'. While on/off mechanism 24' is in the "on" or "intermediate" positions, nozzle assembly 16 rotates and water being discharged through discharge outlets as outlets 16*a*' and/or 16*b*' traverses an arcuate path relative to the rotation axis B-B while the housing 12' remains stationary. Each stream thus discharged has a helical configuration, which is unbroken for so long as the fluid control valve is at least partially open and water is flowing through conduit 13'.

Automatic rotation of nozzle assembly 16' to produce a helical discharge effect can be achieved in a variety of ways. By way of illustrative example, an illustrative nozzle assembly constructed in accordance with this embodiment of the invention may include a motorized drive assembly (not shown) responsive to depression of the trigger or, alternatively, to actuation of an on/off selector switch, and drivingly engageable with appropriate gearing coupled to nozzle assembly 16'. By way of alternate example, discharge outlet 32 of nozzle assembly 19' may be dimensioned and arranged to impart a nozzle reaction force—that is offset relative to the axis of nozzle assembly rotation—as the stream of water is discharged. Even a relatively small angle of inclination of the discharge stream relative to a plane orthogonal to the rotational axis of the nozzle assembly is sufficient to induce rotation of the nozzle assembly.

Figure 4:
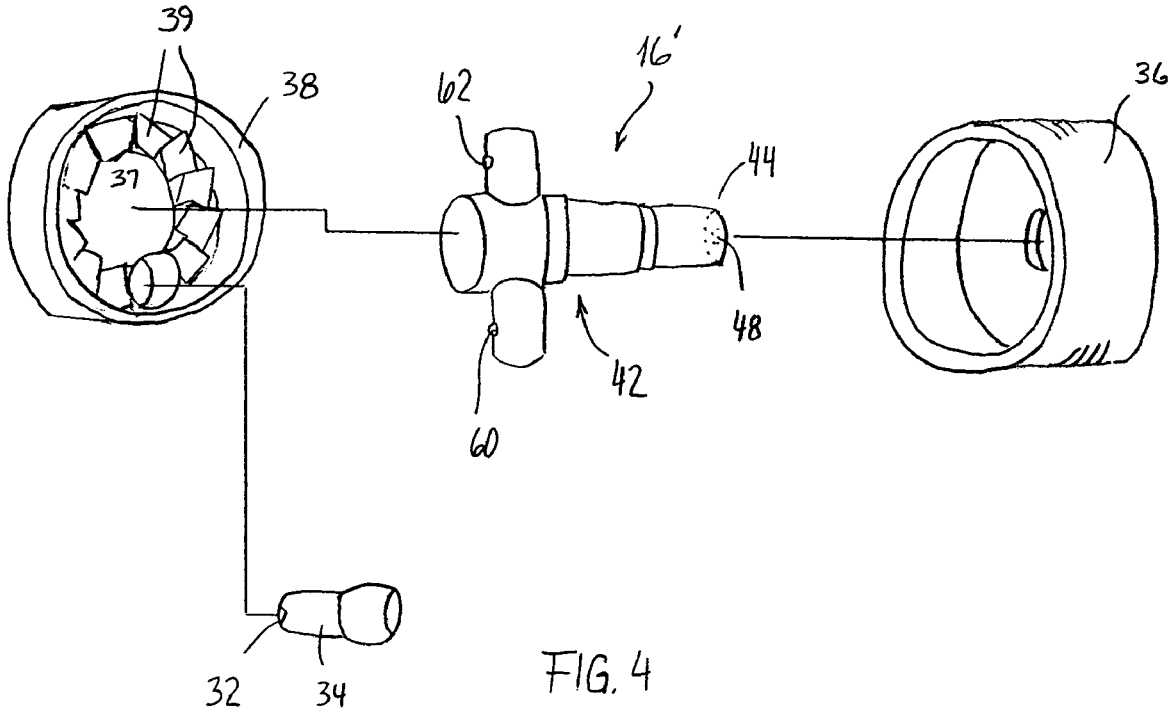
FIG. 4 is broken apart, perspective view depicting the internal construction of an exemplary, rotating nozzle assembly for use in realizing the illustrative embodiment of FIG. 3.
Figure 5:
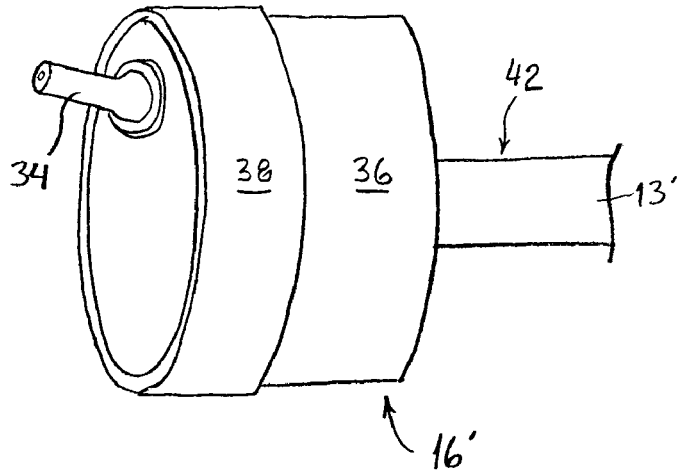
FIG. 5 is a perspective view depicting final assembly of the exemplary rotating nozzle assembly of FIG. 4.
Figure 6:
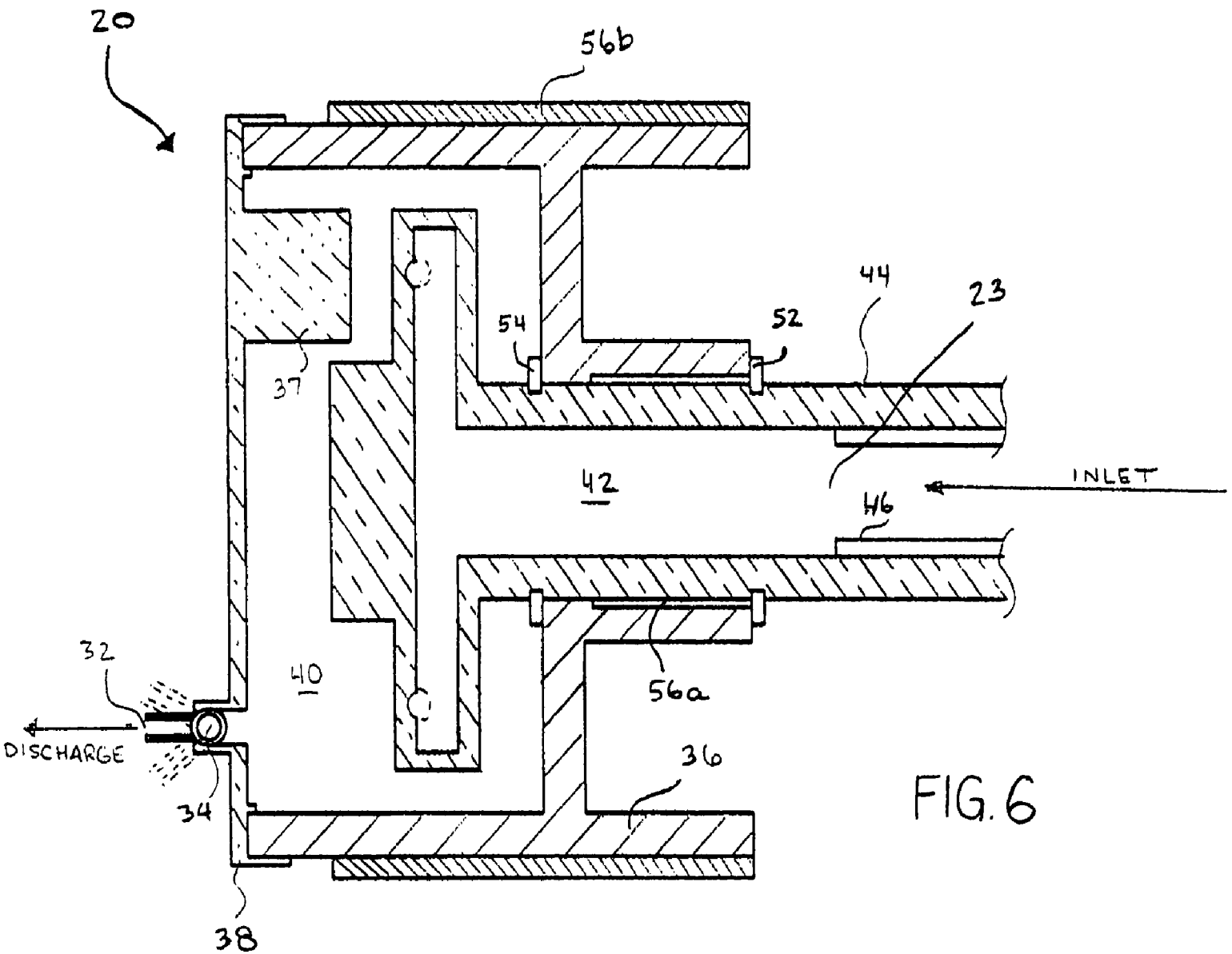
FIG. 6 is a cross sectional view of the exemplary rotating nozzle assembly of FIGS. 4 and 5, taken across the plane VI-VI depicted in FIG. 5.

In accordance with an especially preferred embodiment of the present invention, however, the force for spinning nozzle assembly 19 is provided via the pressurized water stream traversing conduit 13'. An exemplary structure adapted to utilize this force is depicted in FIGS. 4-6 and will now be described in detail. As seen in FIG. 4, nozzle assembly 19' comprises a first section 36 and a second section 38 which, when assembled into the configuration shown in FIGS. 5 and 6, define an interior cavity 40 (FIG. 6) within which is disposed a flow diverter assembly indicated generally at 42.

With reference to both FIGS. 4 and 6, it will be seen that flow diverter assembly 42 has a proximal end 44 dimensioned and arranged to receive and retain the distal end 46 of conduit 13'. Conduit 13' and flow diverter assembly 42 are fastened together in a conventional manner such, for example, as by a suitable adhesive. As such, fluid diverter assembly 42 is not a moving part but, rather, is stationary despite being disposed within interior cavity 40. Fluid exiting the discharge orifice 28 of conduit 13' enters an inlet 48 defined at the proximal end 44 of flow diverter assembly 42. The center of first section 36 defines an axial opening through which proximal end 44 is inserted. Locking rings indicated generally at 52 and 54 in FIG. 6 prevent axial movement of diverter assembly 42 relative to first section 38. A first bushing indicated generally at 56*a* enables first section to rotate about an axis defined by flow diverter assembly 42. To prevent water from leaking out of interior cavity 40, O-rings or other suitable gaskets may be utilized at the interface between the interior surface of bore 36*a* of first section 36 and the exterior surface of diverter assembly 42. A second bushing, indicated generally at 56*b* is provided to retain and support nozzle assembly 20 within housing 12' of device 10' while still allowing it to freely rotate.

Defined within the interior axial surface 37 of second section 38 are a plurality of vanes 39. As best seen in FIG. 4, water entering inlet opening 48 of flow diverter assembly 42 exits via a pair of exit openings indicated generally at 60 and 62. As will be readily appreciated by those skilled in the art, exit opening 60 and 62 are dimensioned and arranged so as to cause corresponding jets of liquid to impinge upon the surfaces of vanes 39, thereby initiating rotation of first section 36 and second section 38.

In the illustrative embodiment depicted in FIG. 3-6, it will be seen that water exits the spinning nozzle assembly 20 via a pivotably movable nozzle member 34. Such a structure is advantageous in that it gives the user a high degree of flexibility in defining the diameter and/or pitch of the helical stream which is discharged. Of course, if such flexibility is not a design constraint, then it is of course possible to integrally form a nozzle member directly as part of second section 38. In that regard, it is contemplated that a nozzle member so constructed may be configured to extend forward at any desired angle relative to the axis of rotation of rotatable nozzle assembly 19'. It is further contemplated that multiple nozzle members may be included so as to cause to simultaneous streams to be helically wound about the axis of nozzle assembly rotation.

Figure 7:
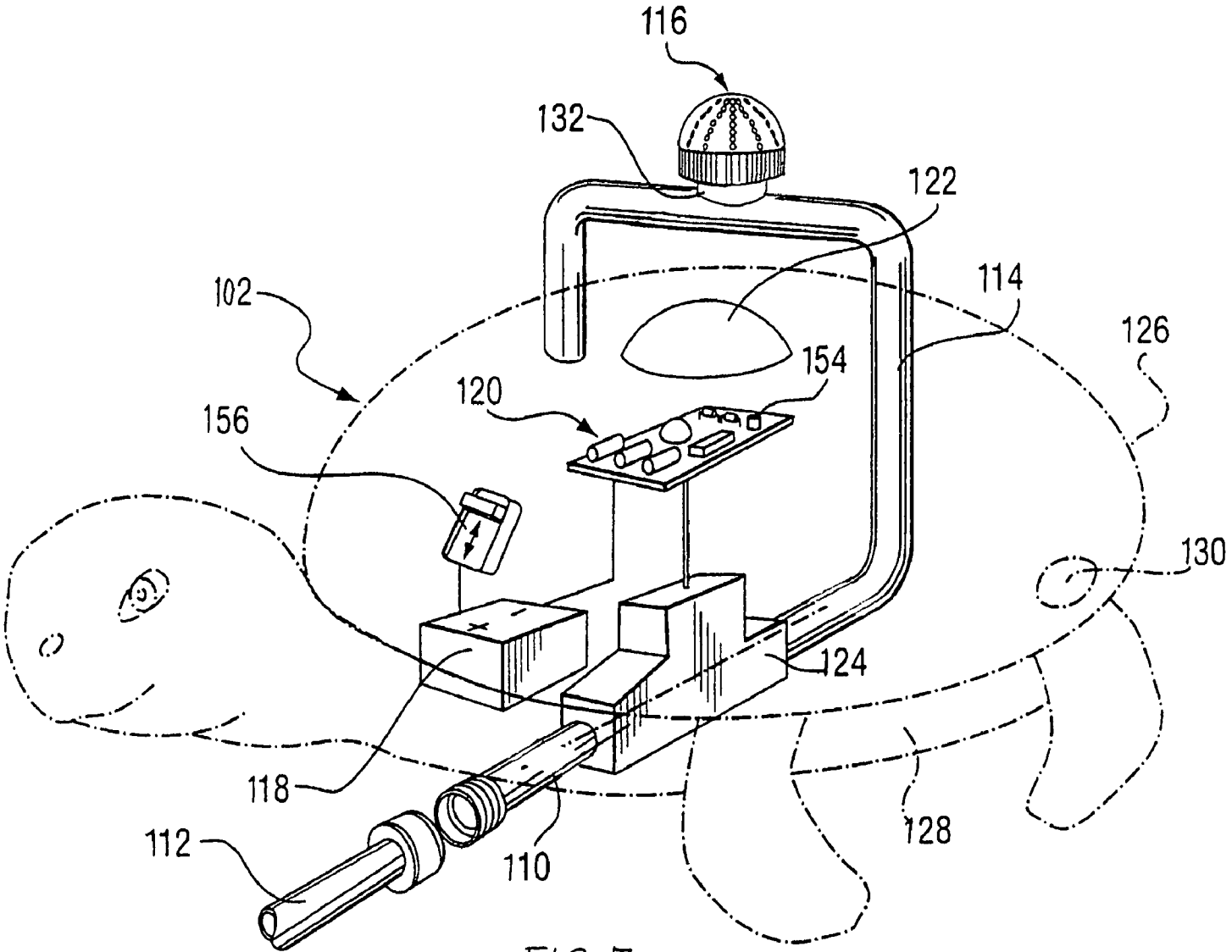
FIG. 7 is a side elevation view depicting a portable water discharging amusement device constructed in accordance with a third illustrative embodiment of the present invention, the device being equipped with several nozzle assemblies adapted to rotate automatically to produce upwardly directed spiral flows, with a motorized pump for urging water from a water containing reservoir to a discharge orifice in each nozzle assembly, and with a motion detection apparatus for selectively operating the motorized pump when a child traverses the water discharge path.

Turning to FIG. 7, there is shown yet another embodiment of a water sprinkler amusement device according to the present invention. The invention of FIG. 7 is essentially identical to that disclosed in U.S. Pat. No. 5,878,956 to Djukastein et al.,—the disclosure of which being expressly incorporated herein by reference in its entirety—with one significant exception. The Djukastein et al. device is directed to a water conserving sprinkler toy and incorporates a motion detector to actuate an on/off mechanism for starting and stopping the flow of water through an avenue of release extending between a source of pressurized water and a fixed nozzle. To the extent the present invention is intended to have only a finite amount of water available during use (i.e., that which can be stored and transported with the device), the teachings of Djukastein et al. are very synergistic with those set forth herein.

As best seen in FIG. 7, the water sprinkler unit 102 comprises a water inlet 110 adapted to be connected to a water outlet 112 of a portable, pressurized water tank (not shown) having an on-board manual or motorized pump for pressurizing its contents. The water inlet 110 is attached to, or integral with, a fluid conduit 114 which fluidly connects the water inlet 110 to a water outlet, typically in the form of a water sprinkler head 116. The fluid conduit 114 can be rigid plastic pipe, or any other suitable material of pipe that is sufficiently durable to withstand repeated use, yet is light enough so that the entire unit 102 remains portable.

As part of the unit 102 there is also provided a power supply 118, illustrated in FIG. 7 as a battery. In line with the power supply 118, there is a circuit 120 controlled by an on/off switch 156 and designed to control a motion detection means 122 and a valve means 124. As illustrated in FIG. 1, the motion detection means 122 is an infrared sensor with 360 degrees visibility. Other degrees of motion detectors may be used in the unit 102, however, it is preferable that the motion detector used have the 360 degrees of visibility.

The circuit 120 is programmed to control ON/OFF mechanism (i.e., valve 124) such that the valve 124 is opened for a pre-determined period of time in response to a signal received from the motion detector 122, which signal corresponds to movement detected by the motion detector 122. With the exception of the pressurizable external tank with on-board pump, the entire unit 102 is intended to be constructed so as to be in combination within a single housing or shell 126, with the water inlet 110 and the sprinkler head 116 accessible from outside the housing 126. Similarly, the housing 126 is constructed of a material or in a manner such that it does not impede the vision of the motion detector 122, nor its range of vision. As illustrated in FIG. 1, the housing or shell 126 can be in various forms, here again llustrated as a turtle, thus increasing the value of the unit 102 as a toy. It is also contemplated that the housing or shell 126 have a weighted base portion 128 for stability. Thus, the base portion 128 of the housing 126 can be constructed so as to be permanently weighted, or there can be provided an access means, illustrated as a plug 130, by which the base portion 128 of the shell 126 can be filled with water, sand or another similar weighting medium, in order to weigh down the unit 102.

It is believed that the disclosure set forth above encompasses multiple distinct inventions with independent utility. While each of these inventions has been disclosed in illustrative form, the specific embodiments thereof as disclosed and illustrated herein are not to be considered in a limiting sense as numerous variations are possible. For example, some embodiments of the present invention may have more than one reservoir, in which case one such reservoir may be a water-receiving, fixed volume fill chamber as reservoir and another may be a water-pressurizable bladder or a fixed-volume, air-pressurizable, chamber (not shown) adapted to receive both water from the fill chamber and pressurized air. Thus, by way of yet another example, fluid transfer system 22 or 22' may be configured as a manually operable, water transfer pump adapted to transfer water from a first, fixed volume chamber into a second, expandable bladder-type chamber.

The subject matter of the inventions includes all novel and non-obvious combinations and sub-combinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and sub-combinations of features, functions, elements and/or properties may be claimed in this or a related application. Such claims, whether they are directed to a different invention or directed to the same invention, whether different, broader, narrower or equal in scope to any original claims, are also regarded as included within the subject matter of the inventions of the present disclosure.

What is claimed is:

1. A free-standing water sprinkler amusement device, comprising:

a housing having a reservoir for receiving and storing water to be transported along with said housing and a bottom designed to support the amusement device in a self-standing operating position on an underlying surface during operation of the device;

a nozzle assembly coupled to said housing and defining at least one discharge orifice, the nozzle assembly being rotatable about an axis of rotation, the at least one discharge orifice being radially offset from the axis of rotation so that the discharge orifice does not pass through the axis of rotation;

an avenue of release extending within said housing, said avenue of release being dimensioned and arranged to establish a path of fluid communication between said reservoir and said nozzle assembly;

an on/off mechanism selectively operable to initiate and terminate flow of water along said avenue of release; and a fluid transfer system operative to develop forces for causing water to flow through the avenue of release and out of the at least one discharge orifice upon actuation of said on/off mechanism, said discharge orifice being arranged such that the flow caused by said fluid transfer system is discharged from said at least one discharge orifice as a continuous helical stream during rotation of said nozzle assembly.

2. The water sprinkler amusement device according to claim 1, wherein the fluid transfer system is operative to transfer pressurizing fluid into the reservoir.

3. The water sprinkler amusement device according to claim 2, wherein the pressurizing fluid is air.

4. The water sprinkler amusement device according to claim 2, wherein the fluid transfer system is a manually operated pump and wherein the on/off mechanism is a valve disposed along the avenue of release.

5. The water sprinkler amusement device according to claim 2, wherein the fluid transfer system is an electrically motorized pump and wherein the on/off mechanism is a normally open switch manipulable into a closed position for energizing the electrically motorized pump.

6. The water sprinkler amusement device according to claim 1, wherein the reservoir is disposed within the housing.

7. The water sprinkler amusement device according to claim 6, wherein the housing defines a threaded fill opening for allowing unpressurized water to be poured into the reservoir, said device further including a removable cap dimensioned and arranged for sealing engagement over said threaded fill opening.

8. The water sprinkler amusement device according to claim 1, wherein the at least one nozzle assembly further includes a plurality of vanes disposed therein, said vanes being dimensioned and arranged to convert energy imparted by the flow caused by said fluid transfer system impinging thereon into forces driving rotation of said nozzle assembly.

9. The water sprinkler amusement device according to claim 1, wherein a first nozzle assembly is rotatably coupled to the housing for rotation about a first, substantially vertical axis and wherein a second nozzle assembly is rotatably coupled to the housing for rotation about a second axis inclined at an acute angle relative to a horizontal plane transecting said first, substantially vertical axis.

10. A method of using a free-standing water sprinkler amusement device having a housing, a reservoir for receiving and storing water to be transported along with the housing, a nozzle assembly defining at least one discharge orifice and being rotatable about an axis of rotation, the at least one discharge orifice being radially offset from the axis of rotation so that the discharge orifice does not pass through the axis of rotation, an avenue of release extending within the housing and being dimensioned and arranged to establish a path of fluid communication between the reservoir and the nozzle assembly, an on/off mechanism, and a fluid transfer system, said method comprising the steps of:

filling, at a first location, the reservoir of the sprinkler system with water supplied from a source of water;

transporting the sprinkler system to a second location remote from the source of water;

setting a bottom of the sprinkler system on an underlying surface, the bottom supporting the sprinkler system in a self standing operating position on the underlying surface during operation of the sprinkler system;

actuating the on/off mechanism and operating the fluid transfer system to develop forces causing water to flow through the avenue of release and to be ejected out of the at least one discharge orifice along a discharge path; and arranging the discharge orifice such that the flow caused by said fluid transfer system is discharged from said at least one discharge orifice as a continuous helical stream when the nozzle assembly is rotated.

11. The method of claim 10, further including a step of rotating the at least one nozzle assembly by directing the flow caused by said fluid transfer system onto a plurality of vanes disposed in the at least one nozzle assembly, said vanes being dimensioned and arranged to convert energy imparted by the flow caused by said fluid transfer system impinging thereon into forces driving rotation of the nozzle assembly.

12. The method of claim 10, wherein at least some water ejected out of the at least one discharge orifice is ejected along an arcuate discharge path.

13. The method according to claim 10, wherein said step of actuating the on/off mechanism and operating the fluid transfer system comprises closing an on/off selector switch to energize an electrically operated pump and to thereby pressurize the reservoir so that water flows through the avenue of release.

14. The method according to claim 13, wherein the reservoir is pressurized with air by operating the electrically operated pump.

15. The method according to claim 10, wherein said step of actuating the on/off mechanism and operating the fluid transfer system comprises closing an on/off selector switch to energize an electrically operated pump and to thereby pump water from the reservoir so that water flows through the avenue of release.

16. The method according to claim 10, wherein said step of actuating the on/off mechanism and operating the fluid transfer system comprises operating a manually operable pump to pressurize the reservoir and opening a valve disposed along the avenue of release so that water flows through the avenue of release.

17. The method according to claim 16, wherein the reservoir is pressurized with air by operating the manually operable pump.

18. The method according to claim 10, further includes a step of introducing water under pressure directly into the reservoir, whereby forces for causing water to flow through the avenue of release are developed without operating the fluid transfer system.

19. A method of using a free-standing water sprinkler amusement device having a housing, a reservoir for receiving and storing water to be transported along with the housing, a nozzle assembly defining at least one discharge orifice and being rotatable about an axis of rotation, the at least one discharge orifice being radially offset from the axis of rotation so that the discharge orifice does not pass through the axis of rotation, an avenue of release extending within the housing and being dimensioned and arranged to establish a path of fluid communication between the reservoir and the nozzle assembly, an on/off mechanism, and a fluid transfer system, said method comprising the steps of:

filling, at a first location, the reservoir of the sprinkler system with water supplied from a source of water;

transporting the sprinkler system to a second location remote from the source of water;

setting a bottom of the sprinkler system on an underlying surface, the bottom supporting the sprinkler system in a self-standing operating position on the underlying surface during operation of the sprinkler system;

actuating the on/off mechanism and operating the fluid transfer system to develop forces causing water to flow through the avenue of release and to be ejected, while no water is flowing into the reservoir, out of the at least one discharge orifice along a discharge path, the discharge orifice being arranged such that the flow caused by said fluid transfer system is discharged from said at least one discharge orifice as a continuous helical stream when the nozzle assembly is rotated.

20. The method of claim 19, further including a step of rotating the at least one nozzle assembly by directing the flow caused by said fluid transfer system onto a plurality of vanes disposed in the at least one nozzle assembly, said vanes being dimensioned and arranged to convert energy imparted by the flow caused by said fluid transfer system impinging thereon into forces driving rotation of the nozzle assembly.

* * * * *